United States Patent [19]

Pilolla

[11] Patent Number: 4,998,673

[45] Date of Patent: Mar. 12, 1991

[54] SPRAY HEAD FOR AUTOMATIC ACTUATION

[75] Inventor: Joseph J. Pilolla, Elmhurst, Ill.

[73] Assignee: Sloan Valve Company, Franklin Park, Ill.

[21] Appl. No.: 180,784

[22] Filed: Apr. 12, 1988

[51] Int. Cl.[5] ..... E03C 1/05

[52] U.S. Cl. ..... 239/67; 4/623

[58] Field of Search ..... 4/623, DIG. 3; 239/67, 239/289; 222/52; 137/131, 801; 250/221

[56] References Cited

U.S. PATENT DOCUMENTS 3,214,596 10/1965 Schwerdt ..... 350/276 SC
3,488,103 1/1970 Webb ..... 350/276 R
4,722,372 2/1988 Hoffman et al. ..... 4/623

FOREIGN PATENT DOCUMENTS 3100773 11/1981 Fed. Rep. of Germany ..... 4/623
3135861 3/1983 Fed. Rep. of Germany ..... 4/623
1084156 9/1967 United Kingdom ..... 4/623

*Primary Examiner*—Andres Kashnikow
*Assistant Examiner*—Kevin Weldon
*Attorney, Agent, or Firm*—Kinzer, Plyer, Dorn, McEachran & Jambor

[57] ABSTRACT

A water spray head for a shower or sink includes means for emitting and receiving signals for automatic operation in response to the presence of a user. The means are positioned such that the stream of water surrounds the emitting and receiving means. The emitting and receiving means includes conduit means disposed within at least a portion of water supply connected to the spray head. In one embodiment, the conduit is in the form of a fiber optic cable. In another, an emitter and detector are mounted in the spray head and the conduit comprises electrical conductors.

35 Claims, 3 Drawing Sheets

SPRAY HEAD FOR AUTOMATIC ACTUATION

BACKGROUND OF THE INVENTION

This invention relates to a shower head or sink spray head of the type having signaling means for "handleless" operation. The invention is specifically concerned with a spray head having signal emitting and receiving means built into the spray head.

Spray heads for shower stalls or hospital scrub sinks are known. In connection with scrub sinks, at least, it has been known to associate automatic flow control means with the spray head to activate flow of water in response to the presence of a user. Flow control devices include electro-magnetic, proximity-sensing pyroelectric and Doppler-type sensors.

One difficulty associated with prior arrangements is the location of the signal emitting and receiving mechanisms. Often mounted remote to the pattern of spray from the spray head, sensing difficulties are experienced, or overt movements out of the path of spray are required of the user to activate the system. The spray head of the present invention overcomes these difficulties.

SUMMARY OF THE INVENTION

The present invention is directed to a spray head for a shower or sink which includes signal emitting and receiving means for the purpose of automatic actuation of flow in response to the presence of a user. The means are disposed such that the spray engulfs or surrounds the signal emitting and receiving means.

DETAILED DESCRIPTION OF THE INVENTION

Figure 1:
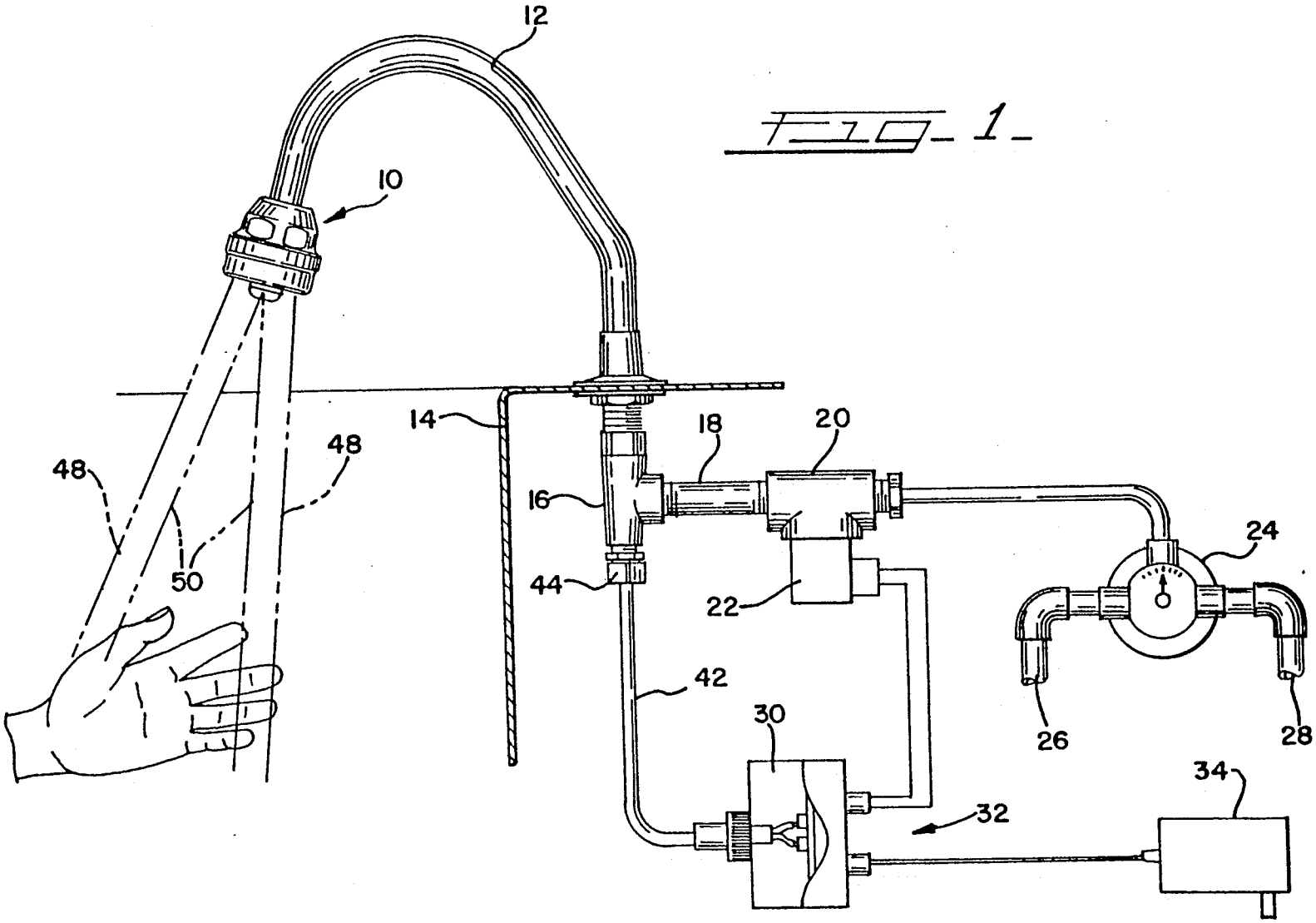
FIG. 1 is a schematic view of a faucet utilizing the spray head of the present invention in a scrub sink application.

A system utilizing the spray head of the present invention is shown schematically in FIG. 1. The spray head, indicated generally by the numeral 10, is connected to a conduit in the form of a U-shaped or gooseneck hollow spout 12 which is mounted on a scrub sink or basin 14. The spout 12 is connected to a tee 16, which in turn is connected to a water supply line 18. The water supply line 18 includes a valve 20 which controls the flow of water through the supply line 18 in accordance with the condition of a solenoid 22. An adjustable or preset temperature mixing valve 24 mixes hot and cold water in lines 26 and 28 which are connected to a suitable water supply.

Operation of the spray head of the illustrated embodiment is controlled by an electronic control means indicated schematically at 30. The control means 30 in this embodiment includes emitting and detecting circuitry for emitting and detecting infrared signals. Electrical power is supplied to the control means 30 through a circuit generally designated as 32 which includes a transformer 34 connected to line voltage. The electronic control means 30 is connected to the solenoid 22 to activate the flow of water in response to a detected signal.

Figure 2:
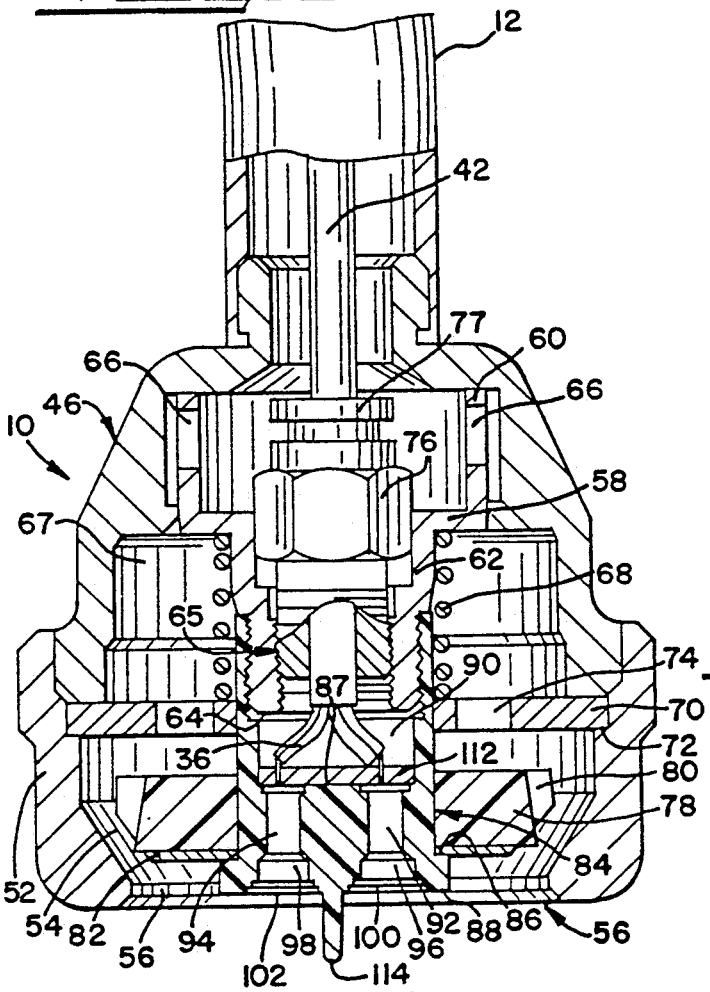
FIG. 2 is an enlarged section through the spray head.

As seen in FIG. 2, electrical conductors 36 connect the control means 30 to a light emitting diode (LED) emitter 38 and a photo transistor detector 40. A suitable emitting diode is an OP295C gallium aluminum arsenide infrared emitting diode available from the Optoelectronics Division of TRW Electronic Component Group, Carrollton, Tex. A suitable phototransistor is the OP501 SLA NPN silicon phototransistor available from the same source. The electrical conductors 36 here are two wire conductors, housed in a protective conduit 42 which extends from the control means 30, through packing nut 44, into tee 16, through spout 12 and into the spray head 10. In the illustrated embodiment, signals are emitted by the emitter 38 and detected by the detector 40 to control solenoid 22 in response to the presence of a user as will become apparent. Any suitable circuitry may be utilized to control operation of the solenoid valve 20. An example of a suitable circuit is found in copending application for U.S. patent Ser. No. 157,606, filed Feb. 19, 1988, and owned by the common assignee of this application. Other control circuits that could be adapted to use with the spray head of the present invention are shown in U.S. Pat. Nos. 3,151,340, 3,415,278, 3,491,381, 3,505,692, 3,551,919, 3,585,652, 3,575,640, 4,309,781, 4,398,310, 4,402,095 and 4,682,628. Also, the control means need not utilize infrared signals. Other forms of sensing arrangements such as electro-magnetic proximity sensing, pyroelectric and Doppler-type sensors could be used.

The spray head 10 disperses water in a spray pattern indicated schematically at 48. The emitter 38 receives a current through conductors 36 which cause the emitter 38 to emit infrared light signals. The signals from LED 38 are directed to a sensing zone, indicated schematically at 50, which represents the field of view of phototransistor 40. As seen, the zone 50 is engulfed by the spray so that the stimulus to activate the spray is necessarily positioned within the spray path in order to initiate operation. When a user places his hand or other body portion within the sensing zone 50, the light emitted from the LED 38 contacts and reflects toward the detector 40. The detector 40 detects the light and transmits an electrical signal or current to the control means 30 via other of the electrical conductors 36. This activates the circuitry in the control means 30 which energizes the solenoid 22 opening the valve 20, thereby allowing water to flow through the supply line 18, spout 12 and spray head 10. Water will flow for as long as the user is within the sensing zone. When, for example, in the instance of the spray head 10, the hands are removed, the detector 40 no longer detects reflected light so the control means 30 ultimately deenergizes the solenoid 22, closing valve 20.

Details of the spray head 10 are shown in FIG. 2. The spray head 10 includes a substantially bell-shaped housing 46 threaded or otherwise fastened onto the end of the water supply spout 12. The housing 46 includes a nut 52 threaded thereto which includes generally inverted conical seat 54 defining outlet opening 56. Flow control means are mounted in the housing 46 for directing water through the housing 46 and out of the outlet opening 46 of the nut 52 in a controlled spray pattern indicated at 48 in FIG. 1. The flow control means also comprise means to support the signal emitting and receiving means within the spray head.

The flow control means includes a movable piston 58 having an upper cylindrical chamber defined by a flange portion 60 and an integral, hollow stem 62 threaded internally and externally at open end 64. A plurality of ports 66 are formed in the sides of the upper portion of the piston 58. The piston 58 is biased upwardly toward the spout end of housing 46 by a spring 68 engaging the underside of the flange portion 60. The spring 68 rests on a mounting plate 70 which is held between the bottom land of the housing 46 and a shoulder 72 on the nut 52. The piston 58 is slidable with respect to plate 70. The mounting plate 70 includes a plurality of passages 74 placed in a circular pattern to permit passage of water as will be explained.

A PrestoLok TM fitting 76, having an aperture formed through the center thereof, is threaded into the piston 58 upon the internal thread 65 at open end 64. These threads are pipe threads. The conduit 42 containing the electrical conductors 36 is inserted through the aperture in the fitting 76 and sealed against the surrounding water by element 77 which creates a fluid tight seal. The electrical conductors 36 extend outwardly from the end of the conduit 42 at open end 64 of piston 58.

A substantially cylindrical retainer assembly, generally designated by the numeral 84, is secured to the external thread of open end 64 of piston 58. It includes a shoulder 86 adjacent its outer end or face 88 exposed at outlet opening 56. Retainer assembly 84 is made of plastic such as "Noryl" ABS plastic available from General Electric Company. A diverter plate 78 which may be made of similar plastic is pressed onto the outer diameter of retainer assembly 84. Diverter plate 78 captures a nameplate 82 against shoulder 86.

Figure 3:
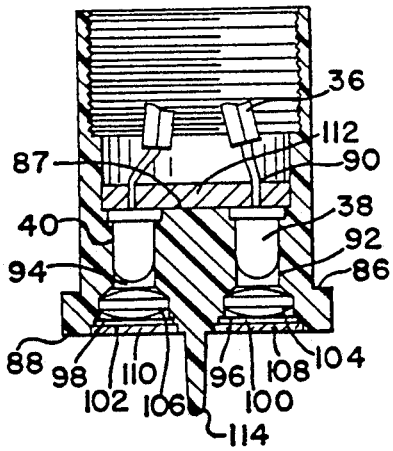
FIG. 3 is a sectional view of the retainer assembly of the spray head in FIG. 2.
Figure 4:
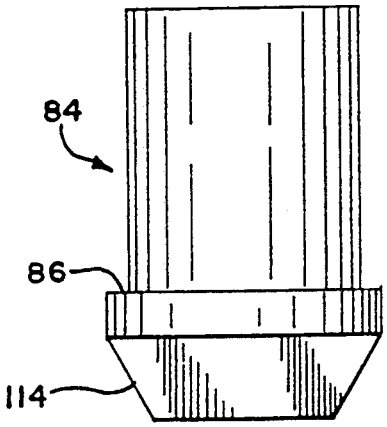
FIG. 4 is a side view of the retainer assembly of the spray head in FIG. 2.
Figure 5:
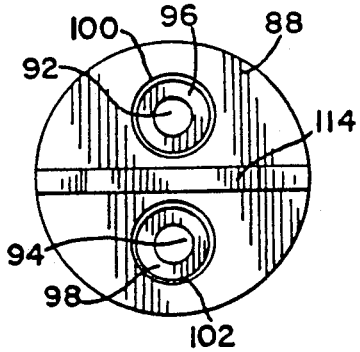
FIG. 5 is an end view of the retainer assembly shown in FIG. 4.

As best seen in FIG. 3, the retainer assembly 84 is open at the upper end and defines a hollow chamber 90 which extends approximately $\frac{2}{3}$ the length of retainer assembly 84. The inner circumference of the upper portion of the chamber 90 is threaded. These threads secure the retainer to the external threads on open end 64 of stem 62 in a water tight relationship.

The remaining $\frac{1}{3}$ of the retainer assembly 84 is substantially solid from wall 87 and has defined therein a pair of cylindrical openings 92 and 94 having counterbores 96 and 98, and larger counterbores 100 and 102 at their respective lower ends. The counterbores 100 and 102 are open through face 88 of the retainer assembly 84.

Each counterbore 96 and 98 is adapted to secure an equaconvex lense 104 and 106, respectively. The counterbores 100 and 102 in the face 88 of the retainer assembly 84 are provided with respective transparent thermoplastic windows 108 and 110, which lie flush with the face 88. These windows 108, 110 are ultrasonically welded in place and are water tight.

Cylindrical opening 92 is adapted to receive the LED 38. The photo transistor 40 is positioned in cylindrical opening 94. The emitter 38 and detector 40 are then centrally positioned in outlet opening 54 and face in the direction of the pattern of spray such that the zone 50 is within or generally coextensive with the spray pattern.

A circular-shaped P.C. board 112 is disposed within the upper portion of the chamber 90 such that it lies adjacent to and in face contact with the solid wall 87 of the retainer assembly 84. The emitter 38 and detector 40 include leads which extend outwardly beyond the base of the P.C. board 112 and attach to electrical conductors 36 which connect with control means 30. The chamber 90 is filled with a suitable waterproof material or sealer to ensure that the connection of the conductors 36 to the emitter 38 and detector 40 are water tight. The waterproof material may also be placed on the threaded connection of the retainer assembly 84 to the piston open end 64.

A partition 114, shown in FIGS. 2–5 extends outwardly from the face 88 of the retainer assembly 84. The partition 114 is located between the windows 108 and 110 and extends to the perimeter of the face 88. It is provided to help prevent the accidental energization of the solenoid 22 by an inadvertent reflected signal. For example, a water droplet formed on the face 88 could, absent the partition 114, cause activation of the spray head 10.

Water entering the piston 58 causes the piston and assemblage to move toward outlet 56. This movement continues until ribs 80 of diverter plate 78 seat against surface 54. Water is forced to flow out the ports 66 in the piston chamber to the exterior of the piston 58 and into chamber 67. It then passes through passages 74, past the ribs 80 and out the outlet 56. The ribs 80 form a plurality of paths which define the spray pattern.

The specific hardware for carrying out the control logic incorporated in the electronic control means 30 may vary in accordance with the needs of the particular application for the spray head. The circuitry illustrated in copending U.S. application Ser. No. 157,606 is only one example of a suitable circuit. It may provide for an "On" delay and an "Off" delay and it may provide for a maximum cycle time, though the latter feature would probably not be particularly desirable and could be eliminated.

Figure 6:
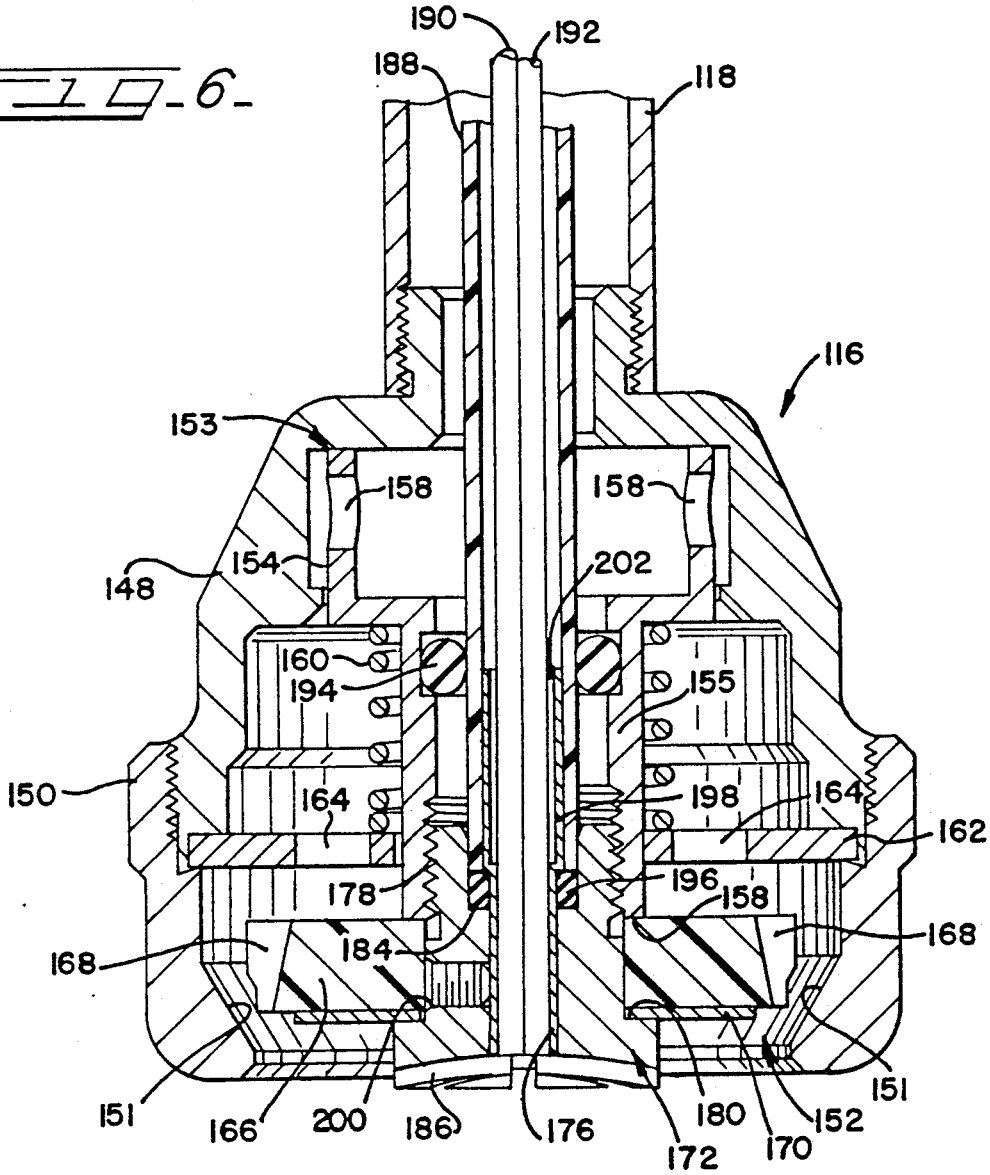
FIG. 6 is an elevational view partially in section of an alternative embodiment of the invention.
Figure 7:
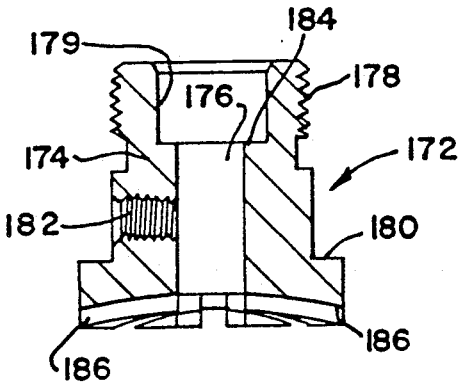
FIG. 7 is a sectional elevational view of a retainer used in the embodiment of FIG. 6.
Figure 8:
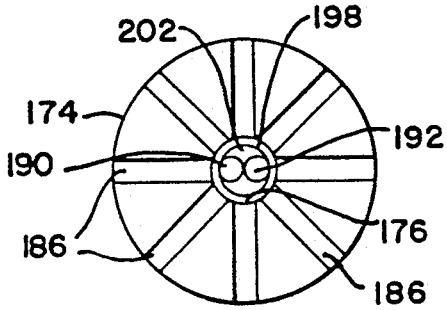
FIG. 8 is an end view of the retainer of FIG. 7.

Turning now to FIGS. 6–8, an alternate embodiment of the spray head of the present invention is illustrated. As in the embodiment of FIGS. 1–5, the spray head 116 includes a generally bell-shaped housing 148 threaded or otherwise fastened onto the end of the water supply spout 118. In this embodiment, the signal emitting and receiving means take the form of fiber optic cables housed in a sheath which extends between the spray head 116 and the control means 30. The sheathed cables extend through spout 118 and packnut 44 to an emitter LED and a detector phototransistor mounted in the control means 30. This embodiment eliminates all electrical conductors from exposure to water.

The housing 148 includes a nut 150 threaded thereto which includes tapered cylindrical seat 151 defining an outlet opening 152. Flow control means are mounted in the housing for directing water through the housing and out of the open end 152 of the nut 150 in a controlled spray pattern similar to the spray pattern indicated at 48 in FIG. 1.

The flow control means includes a movable piston 153 having an upper cylindrical chamber defining flange portion 154 and an integral, hollow stem 155 with an internally threaded open end 156. A plurality of ports 158 are formed in the sides of the upper portion 154 of piston 153. The piston 153 is supported in the housing 148 by a spring 160 engaging the underside of the flange portion 154. The spring 160 rests on a mounting plate 162 which is held between the bottom land of the housing 148 and a shoulder on the nut 150. The mounting plate includes passages 164.

A diverter plate 166 is mounted at the end of the piston stem 155. The plate 166 has a plurality of vanes 168 which direct water out the end of the housing in the desired spray pattern. A nameplate 170 fits on the open face of the diverter 166.

A retaining screw 172 is used to fasten the nameplate 170 and diverter plate 166 to the end of the stem 154. Details of the retaining screw 172 are shown in FIGS. 7 and 8. The retaining screw has a body 174 having a central bore 176 therethrough with an enlarged counterbore 179 forming an O-ring seat. Threads 178 are formed at the upper end of the body, while the lower end has a shoulder 180. A transverse, threaded opening 182 communicates with the bore 176. The lower end face of the retaining screw 172 is illustrated in FIG. 8. That face has a plurality of curved grooves 186 extending from the bore 176 to the periphery of the body 174.

Returning now to FIG. 6, it can be seen that the retaining screw threads 178 engage similar threads in the lower interior portion of the stem 154. The shoulder 180 engages the nameplate 170 and diverter plate 166 to retain those part in position.

The signal conveying means comprise a pair of fiber optic cables 190 and 192 housed within a protective sheath 188. One cable carries infrared signals from emitter 38 in control means 30 and directs these signals to zone 50. The second optic cable receives reflected signals from zone 50 and carries them back to phototransistor 40 to energize the solenoid 22 when a stimulus is present within the zone 50.

The sheath 188 extends through the piston chamber and its opening 156 into the hollow stem 154. A first O-ring seal 194 is disposed in a seat in the stem 154 and engages the sheath 188 to prevent water from flowing along the sheath through the piston stem 154. Thus, water is forced to flow out the ports 158 in the chamber to the exterior of the piston 153, through passages 164 and out the end of the spray head past the vanes 168. The sheath 188 terminates just inside the seat 184 of the retaining screw 172. A second O-ring seal 196 is provided in the seat 184 as a further preventative measure against water reaching the ends of the fiber optic cables 190, 192. The end of the sheath 188 carries a rigid, hollow plug 198 which extends from about the first O-ring 194, past the end of the sheath 188 and into the bore 176 of the retaining screw 172. The plug 198 is held in the bore 176 by a set screw 200 disposed in the opening 182 of the retaining screw. The fiber optic cables 190 and 192 extend into the plug 198 and are potted therein by a resin material 202 (FIG. 8). Thus, it can be seen that the ends of the fiber optic cable are exposed to light entering the bottom of the spray head 116. The ends of the cable are protected from water flowing through the spout 118 and spray head 116 by the sheath 188, O-ring seals 194 and 196, the retaining screw 172 and the plug 198. Water reaching the ends of the fiber optic cables 190, 192, either by splashing or otherwise, is channeled away from the cable by the groove 186.

As can be appreciated, other forms of emitting and receiving means could be used to trigger the circuitry which operates the solenoid 22 to supply water to the spray head. For example, only one of the emitters 38 or detectors 40 need be mounted in the spray head 10. The other could be mounted in the control means 30. One electrical conductor 36 could connect the active element in the spray head to the control means 30. The other could be in communication with zone 50 through a fiber optic cable 190 or 192.

Whereas a preferred form of the invention has been shown and described, it will be understood that modifications can be made thereto without departing from the scope of the following claims.

What is claimed is:

1. A spray head for automatic actuation of flow, said spray head comprising a housing having an inlet and an outlet to receive and direct flow in a predetermined pattern of spray, signal emitting and receiving means connected to said housing for emitting and receiving signals from a zone, said outlet of said housing surrounding said signal emitting and receiving means such that said zone is engulfed by said predetermined pattern of spray upon initiation of flow.

2. A spray head as claimed in claim 1 wherein said signal emitting and receiving means comprise respectively a light emitting diode and a phototransistor.

3. A spray head as claimed in claim 1 wherein said signal emitting and receiving means comprise a pair of fiber optic cables.

4. A spray head as claimed in claim 1 wherein said signal emitting and receiving means comprise respectively a light emitting diode and a fiber optic cable.

5. A spray head as claimed in claim 1 wherein said signal emitting and receiving means comprise respectively a fiber optic cable and a phototransistor.

6. A spray head as claimed in claim 1 wherein said housing includes means for supporting the signal emitting and receiving means within said housing, said signal emitting and receiving means being disposed centrally of said outlet opening facing in the direction of said predetermined pattern of spray.

7. A spray head as claimed in claim 6 wherein said means for supporting said signal emitting and receiving means within said housing comprises a nut threadably fastened about said housing having disposed therein a retaining screw, said screw having a body and a central bore through said body for receiving said signal emitting and receiving means therein, and seal means in said retaining screw to prevent water from flowing along said signal emitting and receiving means.

8. A spray head as claimed in claim 7 wherein the outer end of said retaining screw has a plurality of grooves in communication with said central bore, said grooves extending to the periphery of said body to channel water away from said signal emitting and receiving means.

9. A spray head as claim in claim 7 wherein said signal emitting and receiving means are contained within a protective sheath.

10. A spray head as claimed in claim 9 further comprising a hollow, rigid plug fastened to the end of said sheath and extending into said central bore of said retaining screw, said signal emitting and receiving means extending beyond said sheath and into said plug.

11. A spray head as claimed in claim 10 further comprising a set screw engaging said plug to hold it in said central bore of said retaining screw.

12. A spray head as claimed in claim 6 wherein said means for supporting said signal emitting and receiving means within said housing consists of a nut threadably fastened about said housing, said nut having disposed therein a retainer assembly, said retainer assembly having a body defining a chamber at one end and a solid portion at the other end, said solid portion defining a face, said retainer assembly secured in water right relationship.

13. A spray head as claimed in claim 12 wherein said solid portion of said retainer assembly defines a pair of cylindrical openings, one of said openings adapted to receive a signal emitting device and the other of said openings adapted to receive a signal receiving device.

14. A spray head as claimed in claim 13 wherein said openings further define respective counterbores, each of said counterbores adapted to secure a lense.

15. A spray head as claimed in claim 14 wherein said counterbores further define at their lower ends larger counterbores, said larger counterbores open through said face of said retainer assembly, each of said larger counterbores provided with a transparent window.

16. A spray head as claimed in claim 15 wherein said face of said retainer assembly defines a portion, said partition located between said windows and extending to the perimeter of said face.

17. A faucet system for automatic activation of water flow comprising a water supply line connectable to a water source, a spout connected to said water supply line, a spray head attached to the end of said spout and having a flow control means for dispersing water out of said spray head in a controlled spray pattern having an included dry zone where no water is directed, control means for detecting the presence of a user, a solenoid valve in said water supply line responsive to said control means to control the flow of water and signal emitting and receiving means connected to said spray head and extending from said control means to said spray head at least partially within said spout, said emitting and receiving means exposed at said spray head for emitting and receiving signals to and from said included dry zone of said spray pattern, said flow control means defining a water outlet surrounding said exposed portions of said emitting and receiving means such that said zone is engulfed by said spray pattern on initiation of flow.

18. The faucet system of claim 17 further comprising a retaining screw fastened to said flow control means, said screw having a body and a central bore through said body for receiving said signal emitting and receiving means therein, and seal means in said retaining screw to prevent water from flowing along side said emitting and receiving means.

19. The faucet system of claim 18 wherein the outer end of said retaining screw has a plurality of grooves in communication with said central bore, said grooves extending to the periphery of said body to channel water away from said signal emitting and receiving means.

20. The faucet system of claim 12 wherein said signal emitting and receiving means are contained within a protective sheath.

21. The faucet system of claim 20 further comprising a hollow, rigid plug fastened to the end of said sheath and extending into said central bore of said retaining screw, said signal emitting and receiving means extending beyond said sheath and into said plug.

22. The faucet system of claim 21 further comprising a set screw engaging said plug to hold in said central bore of said retaining screw.

23. The faucet system of claim 22 further comprising a retainer assembly fastened to said flow control means, said retainer assembly having a body defining a chamber at one end for receiving said signal emitting and receiving means therein and a solid portion at the other end, said solid portion defining a face, said retainer assembly secured in water tight relationship.

24. The faucet system of claim 23 wherein said solid portion of said retainer assembly defines a pair of cylindrical openings, one of said openings adapted to receive a signal emitting device and the other of said openings adapted to receive a signal receiving device.

25. The faucet system of claim 24 wherein said openings further define respective counterbores, each of said counterbores adapted to secure a lense.

26. The faucet system of claim 25 wherein said counterbores further define at their lower ends larger counterbores, said larger counterbores open through said face of said retainer assembly, each of said larger counterbores provided with a transparent window.

27. The faucet system of claim 26 wherein said face of said retainer assembly defines a partition, said partition located between said windows and extending to the perimeter of said face.

28. The faucet system of claim 17 wherein the flow control means comprises a piston having a chamber in communication with said spout, at least one port in said chamber to permit flow out said chamber, and a hollow piston stem depending from said chamber, with said signal emitting and receiving means extending through said chamber and stem, said piston being water tight between said stem and said signal emitting and receiving means.

29. The faucet system of claim 27 further comprising a retaining screw fastened to said piston stem, said screw having a body and a central bore through said body communicating with said hollow stem to receive said signal emitting and receiving means therein.

30. The faucet system of claim 29 wherein the outer end of said body has a plurality of grooves in communication with said bore and extending to the periphery of said body to channel water away from said signal emitting and receiving means.

31. The faucet system of claim 28 further comprising a retainer assembly fastened to said piston stem, said retainer assembly having a body defining a chamber at one end and a solid portion at the other end, said chamber communicating with said hollow piston stem to receive said signal emitting and receiving means therein.

32. The faucet system of claim 17 wherein said signal emitting and receiving means comprise respectively a light emitting diode and a phototransistor.

33. The faucet system of claim 17 wherein said signal emitting and receiving means comprise a pair of fiber optic cables.

34. The faucet system of claim 17 wherein said signal emitting and receiving means comprise respectively a light emitting diode and a fiber optic cable.

35. The faucet system of claim 17 wherein said signal emitting and receiving means comprise respectively a fiber optic cable and a phototransistor.

* * * * *